US007305949B2

(12) United States Patent
McCarthy et al.

(10) Patent No.: US 7,305,949 B2
(45) Date of Patent: Dec. 11, 2007

(54) STAMPED TARGET WHEEL FOR A CAMSHAFT PHASER

(75) Inventors: David M. McCarthy, Churchville, NY (US); Natalie G. Payne, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 25 days.

(21) Appl. No.: 11/206,510

(22) Filed: Aug. 18, 2005

(65) Prior Publication Data

US 2007/0039576 A1 Feb. 22, 2007

(51) Int. Cl.
*F01L 1/34* (2006.01)

(52) U.S. Cl. ..... 123/90.17; 123/90.15; 123/195 C; 123/198 E

(58) Field of Classification Search ..... 123/90.17
See application file for complete search history.

(56) References Cited

U.S. PATENT DOCUMENTS 4,784,047 A * 11/1988 Stoll et al. ..... 92/13.5
5,005,281 A * 4/1991 Burns ..... 29/596
5,775,279 A * 7/1998 Ogawa et al. ..... 123/90.17
6,386,167 B1 * 5/2002 Urckfitz et al. ..... 123/90.17
6,732,690 B2 * 5/2004 Pierik et al. ..... 123/90.17
6,802,289 B2 * 10/2004 Miyazaka et al. ..... 123/90.17
6,868,812 B2 * 3/2005 Saito et al. ..... 123/90.17

* cited by examiner

*Primary Examiner*—Thomas Denion
*Assistant Examiner*—Kyle M. Riddle
(74) *Attorney, Agent, or Firm*—Paul L. Marshall

(57) ABSTRACT

A target wheel for a camshaft phaser stamped and drawn from sheet metal stock. The hub region of the target wheel may be drawn such that it extends through the phaser cover plate and seals directly against the face of the rotor, allowing a shorter cam bolt and resulting in reduction in mass and cost of the phaser. Alternatively, a separate hub is formed and then attached to a simplified stamped and drawn target wheel, or a target wheel hub is formed integrally with the rotor and extends through the cover plate to mate with a simplified stamped and drawn target wheel. Preferably, the hub is formed having a neck extending through a central opening in the target wheel, which neck is peened over during assembly to secure the wheel to the hub.

7 Claims, 6 Drawing Sheets

STAMPED TARGET WHEEL FOR A CAMSHAFT PHASER

TECHNICAL FIELD

The present invention relates to camshaft phasers for internal combustion engines; more particularly, to target wheels for determining the angular status of a phaser rotor; and most particularly, to an improved target wheel formed as by stamping from sheet metal.

BACKGROUND OF THE INVENTION

Camshaft phasers for varying the timing of valves in internal combustion engines are well known. A typical phaser comprises a rotor, attached to a camshaft, and a stator surrounding the rotor and driven in time with an engine crankshaft. The phaser is able to vary the angular position of the rotor with respect to the stator and thus to vary the valve timing imposed on the camshaft with respect to the crankshaft and pistons.

A phaser also typically includes an external timing wheel having notches, tabs, or other indicia, and being fixedly attached to the rotor such that the angular position of the rotor within the stator may be determined at any time by interrogating the target wheel. A target wheel also typically includes means for anchoring an end of a rotor bias spring.

A prior art target wheel typically is formed by powdered metal (PM) technology, which can add significant mass, and thus inertia, to a rotor assembly, whereas it is desirable that the target wheel be of very low mass to increase speed of response of the phaser. PM is also a relatively expensive means for forming a relatively simple component.

What is need in the art is an inexpensive, low-mass timing wheel for a camshaft phaser.

It is a principal object of the present invention to reduce the rotational mass and cost of a camshaft phaser.

SUMMARY OF THE INVENTION

Briefly described, a target wheel for a camshaft phaser is stamped and drawn from sheet metal stock, reducing the mass and inertia in comparison with a PM target wheel. The hub region of the target wheel may be drawn such that it extends through the phaser cover plate and seals directly against the face of the rotor, allowing a shorter cam bolt, resulting in still further reduction in mass and cost.

In a second embodiment, a separate hub is formed and then attached to a simplified stamped and drawn target wheel.

In a third embodiment, a target wheel hub is formed integrally with the rotor and extends through the cover plate to mate with a simplified stamped and drawn target wheel.

Preferably, the hub is formed having a neck extending through a central opening in the target wheel, which neck is peened over during assembly to secure the wheel to the hub and to accurately control the angular and radial relationships between the rotor and the timing wheel.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
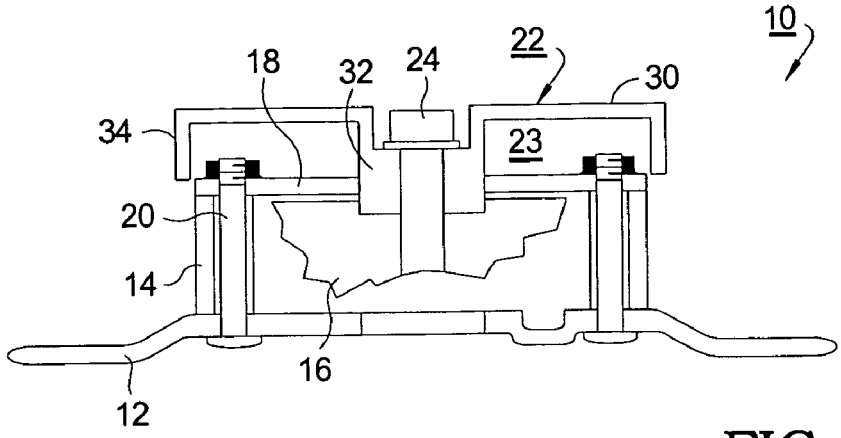
FIG. 1. (PRIOR ART)
FIG. 1 is an elevational cross-sectional schematic view of a prior art camshaft phaser.

Referring to FIG. 1, a prior art vane-type camshaft phaser 10 comprises a sprocket 12, a stator 14, a rotor 16 disposed on sprocket 12 and within stator 14, a cover plate 18, binder screws 20, and a target wheel 22. An axial cam bolt 24 secures phaser 10 to a camshaft 26 of an internal combustion engine 28 (see FIG. 14) as well as urges target wheel 22 snugly against rotor 16. Target wheel 22 is angularly indexed to rotor 16 such that the rotational position of rotor 16 may be inferred at any time by interrogating target wheel 22. In a complete phaser assembly, a coiled bias spring may be disposed, as is discussed below, within space 23, having for example a first end anchored to one of the binder screws 20 and a second end anchored to an anchor element formed in the target wheel. The bias spring urges the target wheel and rotor in a predetermined angular direction with respect to the stator and sprocket.

Prior art target wheel 22 comprises a plate portion 30 attached to an integral hub 32 and supporting a generally cylindrical peripheral skirt 34. Typically, skirt 34 is provided with indicia (not visible in FIG. 1) defined by indentations or gaps in the skirt, as described further below with respect to improved target wheels.

Prior art target wheel 22 typically is formed of metal by powdered metal forming or by molding, as is well known in the metal forming arts.

Figure 2:
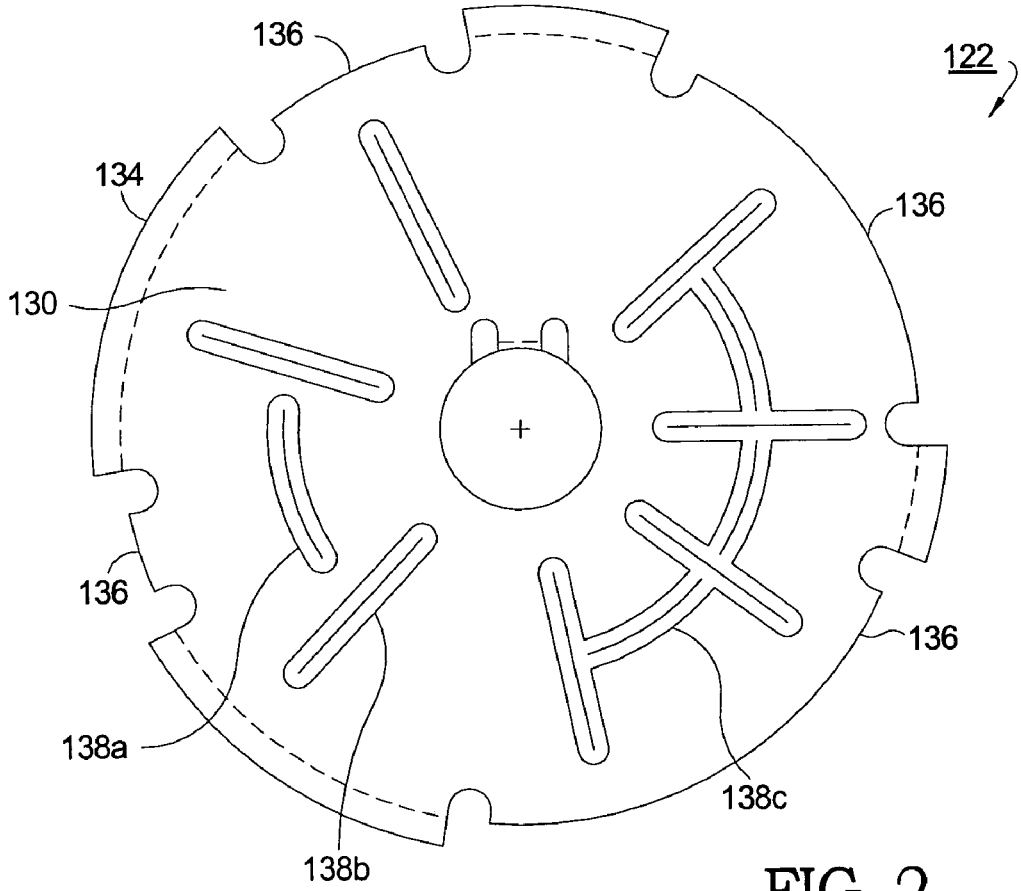
FIG. 2 is a plan view of an improved target wheel in accordance with the invention.

Referring to FIG. 2, an improved target wheel 122 is formed as by stamping from sheet metal of a predetermined gauge. A continuous or discontinuous (as shown) skirt 134 is formed integrally with the plate portion 130 and is broken by gaps 136 which permit interrogation of the wheel as by an optical beam either axially or radially. Skirt 134 may extend toward or away from the phaser rotor.

Being formed from flexible sheet metal, wheel 122 is preferably strengthened against flexure by integral ribs 138 stamped into plate portion 130 and extending axially either toward or away from the phaser rotor. Ribs 138 may be formed circumferentially 138*a*, radially 138*b*, or both circumferentially and radially 138*c*.

Figure 3:
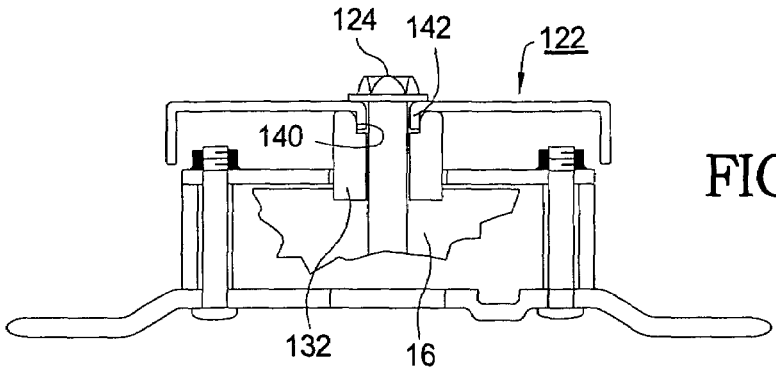
FIG. 3 is a an elevational cross-sectional schematic view of a first embodiment of an improved target wheel in accordance with the invention.

Referring to FIG. 3, wheel 122 is shown mounted to a hub insert 132. Hub insert 132 preferably is formed by PM or screw machine from metal stock, has the same diameter as hub 32, and is a direct replacement therefor. Hub insert 132 includes an annular recess 140. An axial collar 142 formed on wheel 122 is pressed into recess 140 to secure wheel 122 to insert 132 after indexing of the wheel to the insert, which indexing is permanently secured by bolt 124 during engine assembly.

Figure 4:
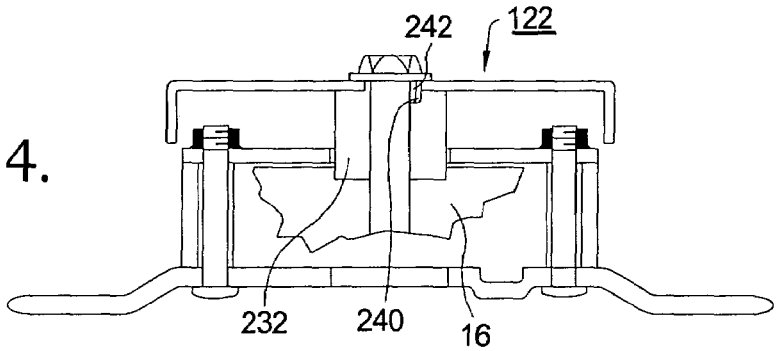
FIG. 4 is a an elevational cross-sectional schematic view of a second embodiment of an improved target wheel in accordance with the invention.

Referring to FIG. 4, wheel 122 is shown mounted to an alternative hub insert 232, similar to hub insert 132 but including only a keyway 240 instead of recess 140. Wheel 122 is provided with an axially-extending key 242 which is pressed into keyway 240 during assembly to both index and retain wheel 122 to hub insert 232.

Figure 5:
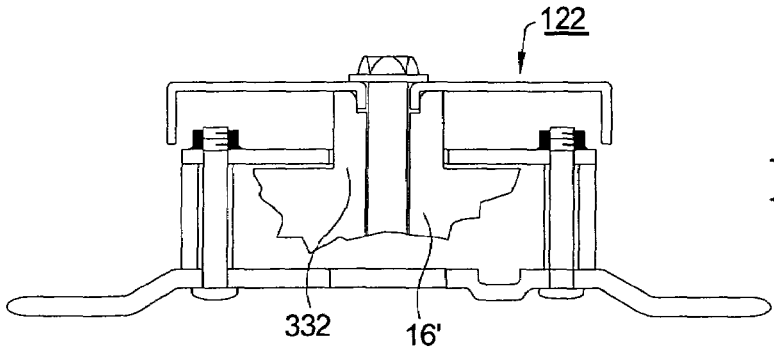
FIG. 5 is a an elevational cross-sectional schematic view of a third embodiment of an improved target wheel in accordance with the invention

Referring to FIG. 5, rotor 16' includes an integral target wheel hub 332 formed as part of the rotor, which may mate with wheel 122 in, for example, either fashion shown in FIGS. 3 and 4.

Figure 7:
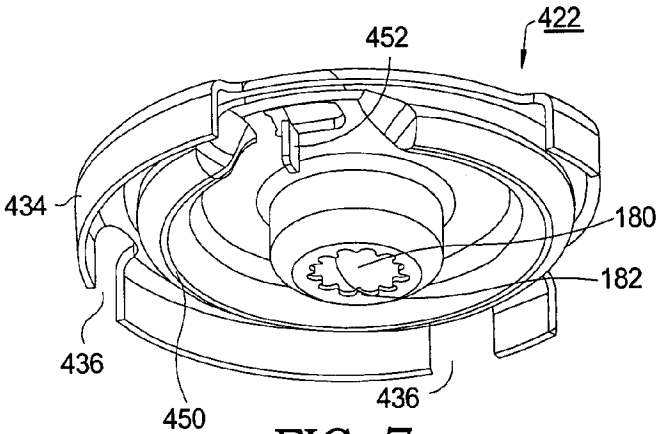
FIG. 7 is an isometric view from below of the target wheel shown in FIG. 6.
Figure 6:
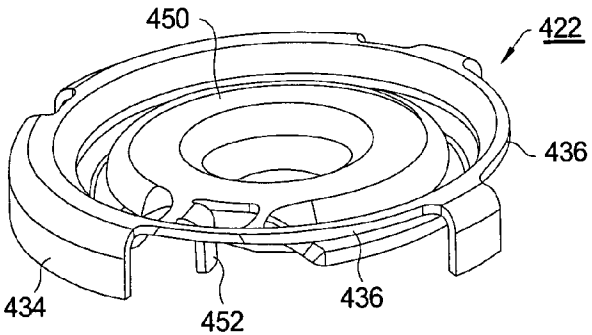
FIG. 6 is an isometric view from above of a target wheel, showing a discontinuous skirt and a stamped spring-anchor tab.
Figure 10:
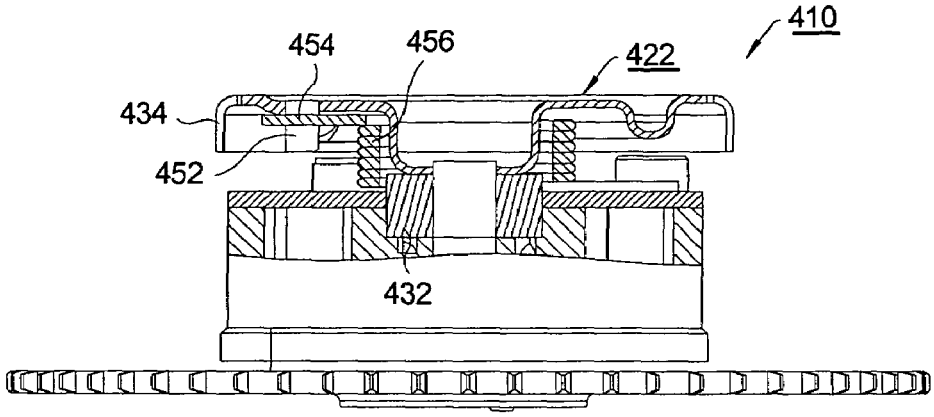
FIG. 10 is an elevational cross-sectional view of a camshaft phaser including the target wheel shown in FIGS. 6 and 7.

Referring to FIGS. 6, 7, and 10, in a first improved camshaft phaser 410 in accordance with the invention, a target wheel 422 has a discontinuous skirt 434 having a plurality of timing gaps 436. Wheel 422 is formed having a plurality of annular corrugations 450 to provide flexural rigidity. An axial spring-anchor tab 452 is provided to engage a first tang 454 of a rotor biasing spring 456.

Figure 9:
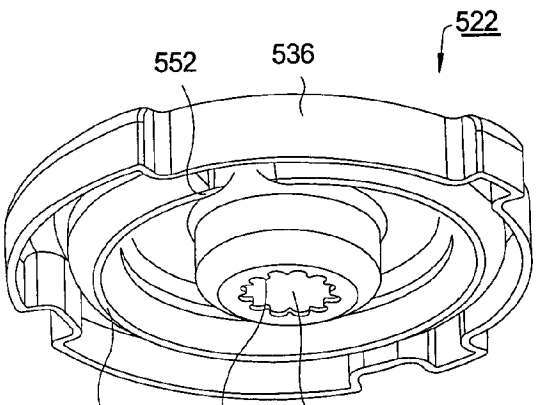
FIG. 9 is an isometric view from below of the target wheel shown in FIG. 8.
Figure 8:
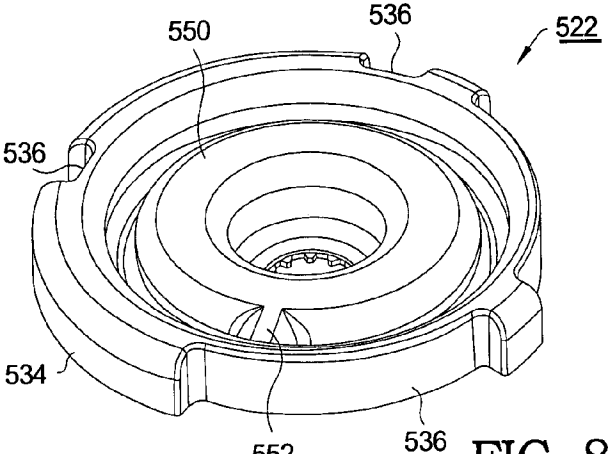
FIG. 8 is an isometric view from above of a target wheel, showing a continuous skirt and a formed spring-anchor groove.
Figure 11:
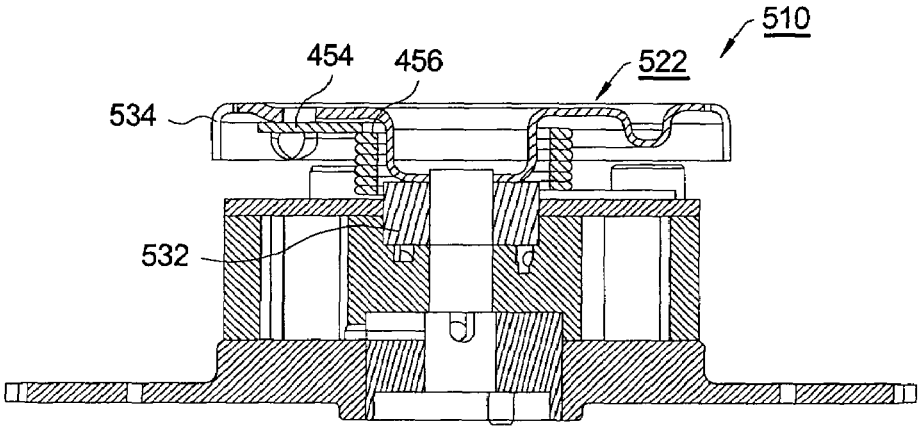
FIG. 11 is an elevational cross-sectional view of a camshaft phaser including the target wheel shown in FIGS. 8 and 9.
Figure 12:
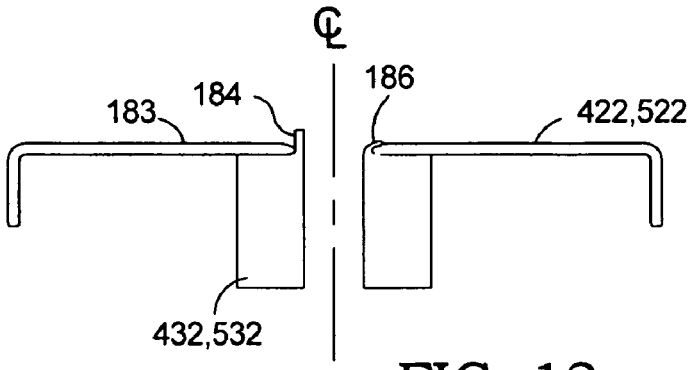
FIG. 12 is a schematic drawing showing an arrangement for attachment of a target wheel to a hub in accordance with the invention.

Referring to FIGS. 8, 9, and 11, in a second improved camshaft phaser 510 in accordance with the invention, a target wheel 522 has a continuous skirt 534 having a plurality of timing indentations 536. Wheel 522 is formed having a plurality of annular corrugations 550 to provide flexural rigidity. A radial spring-anchor groove 552 is formed in a corrugation 550 to engage a first tang 454 of rotor biasing spring 456.

Figure 14:
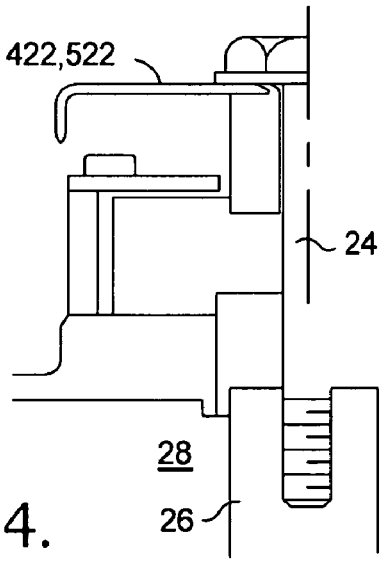
FIG. 14 is a schematic elevational drawing showing a target wheel and phaser mounted onto a camshaft of an internal combustion engine, wherein the target wheel is mounted to the rotor in accordance with FIG. 12.

Referring to FIGS. 7 through 12, a currently-preferred arrangement is shown for attaching a target wheel to a hub insert. The central opening 180 of the wheel is provided with serrations 182 extending inwards of the opening. The hub insert 432, 532 is provided with a thin neck 184 extended axially into opening 180 and beyond an upper surface 183 of wheel 422, 522 during assembly. Neck 184 is peened over 186, causing the material of neck 184 to flow into serrations 182, thus locking the wheel to the hub. The neck is peened flush with the upper surface 183 of the wheel such that bolt 24 can engage the wheel directly, as shown in FIG. 14. Preferably, hub 432, 532 and neck 184 are formed of a malleable metal alloy such as unhardened steel such as cold-rolled steel 1215.

Figure 13:
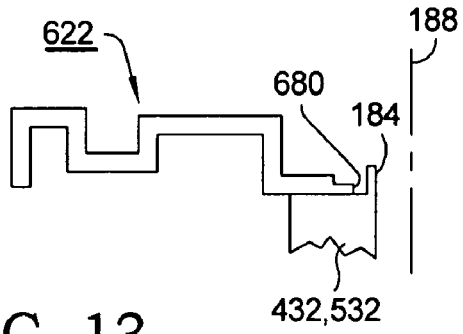
FIG. 13 is a schematic drawing showing a currently-preferred variant of the arrangement shown in FIG. 12.

Modern target wheel sensing systems can be sensitive to radial runout of the target wheel; therefore, it is desirable to provide means whereby the radial runout of the wheel may be nulled during assembly. Referring to FIG. 13, it is seen that central opening 680 in target wheel 622 is slightly larger in diameter than is required to accept neck 184 thereby defining a gap or clearance between central opening 680 and neck 184. The gap permits both the radial position of the target wheel 622 relative to the rotational axis 188 of the phaser and the angular index of the target wheel to the hub insert to be adjusted, prior to peening of neck 184, to a desired null-runout position with respect to the axis 188 of the phaser 410, 510.

Figure 15:
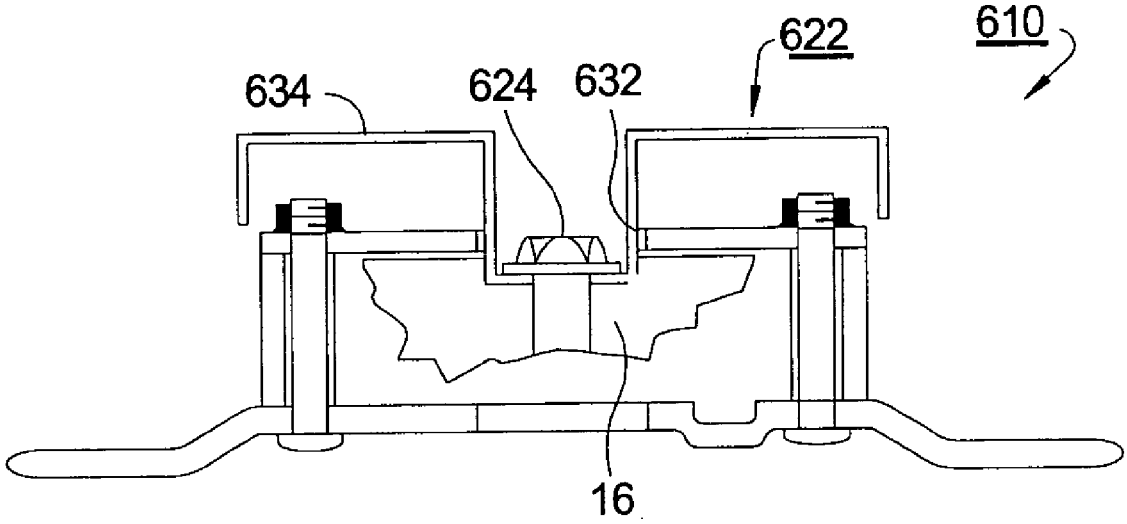
FIG. 15 is a schematic elevational view of a camshaft phaser having a stamped target wheel attached directly to the rotor.

Referring to FIG. 15, in a still further embodiment 610 of a camshaft phaser having a stamped target wheel 622 in accordance with the invention, wheel 622 includes a deep-drawn central portion 632, disposed axially from plate portion 634 of the wheel, defining an integral wheel hub that mates with rotor 16 identically with prior art hub 32, obviating the need for a separate, formed hub insert and permitting use of a shorter, less massive bolt 624.

Target wheels in accordance with the invention are preferably formed by stamping, punching, drawing, fineblanking, or combinations thereof.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A target wheel assembly for a camshaft phaser, comprising:

a) a sheet metal target wheel including a central opening an and upper surface, said central opening including serrations; and b) a hub adapter in fixed communication with a phaser rotor, said hub adapter including an annular neck, wherein said wheel is attached to said hub adapter by deformation of said annular neck into said serrations.

2. A target wheel assembly in accordance with claim 1 further comprising a peripheral skirt.

3. A target wheel assembly in accordance with claim 2 wherein said skirt is selected from the group consisting of continuous and discontinuous.

4. A target wheel assembly in accordance with claim 1 further comprising a tab for anchoring an end of a rotor bias spring.

5. A target wheel assembly in accordance with claim 1 further comprising a formed channel for anchoring an end of a rotor bias spring.

6. A target wheel assembly in accordance with claim 1 wherein said deformed neck is flush with said upper surface of said wheel.

7. A target wheel assembly for a camshaft phaser, comprising:

a) a sheet metal target wheel including a central opening an and upper surface; and b) a hub adapter in fixed communication with a phaser rotor, said hub adapter including an annular neck extending into said central opening and beyond said upper surface of said wheel, wherein a diameter of said central opening is greater than a diameter of said neck wherein a gap is defined between said hub and said central opening to permit radial adjustment of said wheel with respect to said hub adapter during manufacture of said target wheel assembly.

* * * * *